US006943745B2

(12) United States Patent
Rao et al.

(10) Patent No.: US 6,943,745 B2
(45) Date of Patent: Sep. 13, 2005

(54) BEAM RECONFIGURATION METHOD AND APPARATUS FOR SATELLITE ANTENNAS

(75) Inventors: Sudhakar K. Rao, Torrance, CA (US); Guy Goyette, Marina Del Rey, CA (US); Cameron Massey, Hawthorne, CA (US); George Voulelikas, El Segundo, CA (US); Joel A. Fink, Torrance, CA (US)

(73) Assignee: The Boeing Company, Chicago, IL (US)

( * ) Notice: Subject to any disclaimer, the term of this patent is extended or adjusted under 35 U.S.C. 154(b) by 64 days.

(21) Appl. No.: 10/403,740

(22) Filed: Mar. 31, 2003

(65) Prior Publication Data

US 2004/0189538 A1 Sep. 30, 2004

(51) Int. Cl.[7] ..... H01Q 3/00

(52) U.S. Cl. ..... 343/757; 343/880; 343/881; 343/DIG. 2

(58) Field of Search ..... 343/757, 765, 343/840, 878, 880, 881, DIG. 2, 879, 882, 915, 781 R, 781 P, 781 CA

(56) References Cited

U.S. PATENT DOCUMENTS 5,115,248 A 5/1992 Roederer ..... 342/373
5,859,619 A 1/1999 Wu et al. ..... 343/781 CA
6,124,835 A * 9/2000 Nguyen et al. ..... 343/881
6,198,455 B1 3/2001 Luh ..... 343/781 CA

FOREIGN PATENT DOCUMENTS

FR 89 12584 9/1991

OTHER PUBLICATIONS

J. U. I. Syed and A.D. Oliver, "Variable Beamwidth Dual–Reflector Antenna, IEEE Conference on Antennas & Propagation (ICAP)", Publication #407, pp. 92–96, Apr. 1998.

A. Roederer, and M. Sabbadini, "A Novel Semi–Active Multibeam Antenna Concept", IEEE Antennas & Propagation Symposium Digest, pp. 1884–1887, Jul. 1990.

* cited by examiner

*Primary Examiner*—Hoang V. Nguyen
(74) *Attorney, Agent, or Firm*—Gates & Cooper

(57) ABSTRACT

A method, apparatus, article of manufacture, and a memory structure for generating reconfigurable beams is disclosed herein. The apparatus comprises a stationary feed array having a plurality of selectably activatable feed array elements, the feed array having a feed array sensitive axis; a reflector, illuminated by the selectably activatable feed array elements; a first mechanism, coupled to the reflector, for varying a position of the reflector along the feed array axis; wherein a desired beam size of the antenna system is selected by varying the reflector position along the feed array sensitive axis and by selectably activating the feed array elements.

29 Claims, 15 Drawing Sheets

BEAM RECONFIGURATION METHOD AND APPARATUS FOR SATELLITE ANTENNAS

BACKGROUND OF THE INVENTION

1. Field of the Invention

The present invention relates to systems and methods for transmitting/receiving data, and in particular to a system and method for on-orbit reconfiguration of beams transmitted/received by satellite antennas.

2. Description of the Related Art

Commercial and military satellites often require the flexibility in terms of changing the coverage size and the beam location over the global field-of-view. It is also important to keep the feed(s) stationary for most applications either due to the high power required to carry multiple frequency channels on-board the satellite or to avoid long cables required to move the feed(s).

Many existing satellite designs have fixed beam coverages and therefore can not provide any flexibility in terms of coverage patterns on ground and also can not be adapted to changing service requirements once the satellite has been launched.

Future applications for both commercial and military satellites may require the beam shape as well, as the beam location to be reconfigured over the global coverage based on changes in traffic demand, changes in the coverage scenario and/or the need for a service back-up for an on-orbit or launch failure. This flexibility is critical to many satellite operators in order for them to provide uninterrupted service to their customers.

Existing methods of beam reconfiguration involve either moving the feed of a reflector antennas or use of phase array antennas. These are risky due to the high power going through the feed, long and glossy cabling requirement, or very expensive hardware with increased power consumption on satellite.

In the paper "Variable Beamwidth Dual-Reflector Antenna', IEEE Conference on Antennas & Propagation (ICAP)", Publication # 407, pp.92–96, April 1998, which is hereby incorporated by reference herein, authors J. U. I. Syed and A.D. Olver describe a method of changing the beam size by moving the feed of a reflector antenna. They employ a symmetrical Cassegrain reflector antenna with main and sub-reflectors which inherently has high sidelobes and low beam efficiency due to blockage effects caused by the feed and the sub-reflector. This method has limited beam shape reconfiguration due to the fact that the main beam splits or bifurcates for beam aspect ratios greater than 1:2.5 and therefore resulting in poor gain performance.

In another paper, "A Novel Semi-Active Multibeam Antenna Concept", IEEE Antennas & Propagation Symposium Digest, pp. 1884–1887,July 1990, authors A Roederer and M. Sabbadini describe a semi-active multibeam antenna concept for mobile satellites. The beams are reconfigured using a Butler matrix and a semi-active beamformer whereby a limited number of feed elements (typically three or seven) are used for each beam and the beam reconfiguration is achieved by varying the phases through the active BFN. This scheme provides limited reconfigurability over a narrow bandwidth and employs complicated and expensive hardware.

U.S. Pat. No. 6,198,455, entitled "Variable Beamwidth Antenna Systems" and issued to Luh on Mar. 6, 2001, which is hereby incorporated by reference herein, describes an offset dual-reflector antenna in the Gregorian configuration. This requires feed movement and also reflector movement (main or sub-reflector) and also has limited range of beam size reconfiguration (beam size aspect ratio of less than 1:2) due to the use of single feed and has disadvantages associated with feed movement.

U.S. Pat. No. 5,859,619, entitled "Small Volume Dual Offset Reflector Antenna", and issued to T. Wu, B. Yee and G. H. Sinkins on Jan. 12, 1999, which is hereby incorporated by reference herein, describes a compact dual-offset Cassegrain antenna system that requires the position of the feed, position of the sub-reflector and the feed axial direction that need to be changed in order to arrive at a compact antenna configuration. This is mainly intended for fixed beam applications and does not provide the beam size flexibility.

What is needed is an antenna system that provides for control of the beam size as well as the beam direction, and is compatible with a high-power and stationary feed array requirements. What is also needed is a system that extends the range that the beam size can be reconfigured and provides high beam efficiency values over the beam zooming range while minimising scan loss. The present invention satisfies that need.

SUMMARY OF THE INVENTION

To address the requirements described above, the present invention discloses a method and apparatus for generating reconfigurable beams.

The apparatus comprises a stationary feed array having a plurality of selectably activatable feed array elements, the feed array having a feed array sensitive axis; a reflector, illuminated by the selectably activatable feed array elements; a first mechanism, coupled to the reflector, for varying a position of the reflector along the feed array axis; wherein a desired beam size of the antenna system is selected by varying the reflector position along the feed array sensitive axis and by selectably activating the feed array elements.

The method comprises the steps of illuminating a reflector from a stationary feed array having plurality of feed array elements; and changing a width of the beam by varying a distance of the reflector from the feed array along a feed array sensitive axis and selectably activating the feed array elements.

The foregoing provides the desired flexibility in high power applications, by keeping the feed array stationary, and extends the range of beam size reconfiguration by using a variable size feed array and reflector movement. It also provides high beam efficiency values over the zooming range of the beams, while achieving mini scan loss by using reflector gimbaling to scan the beams.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

The reconfigurable beam antenna employs an offset reflector illuminated with a feed array. The feed array is stationary, and the reflector can either be stationary or movable axially towards the feed array. The desired beam reconfigurability is achieved through the use of one or more of the following techniques: (1)varying the number of feed elements through high power switch and a beamforming network (BFN), (2) moving the reflector mechanically towards the feed array along the axial direction, and (3) using gimbal mechanisms behind the reflector to steer the beam(s) over the earth coverage. The first two techniques provide beam size reconfiguration while the third technique provides beam location reconfiguration. The use of a fixed feed array with high power switches and a BFN allows the number of feed array elements to vary depending on the size of the coverage beam.

The reconfigurable antenna system disclosed herein employs an offset reflector being illuminated with a feed array. In one embodiment, the antenna system includes an offset single reflector (solid or mesh type) whereby the reflector surface can either be parabolic or arbitrarily shaped. The reflector may be illuminated with a feed array where the number of elements are varied on-orbit depending on the beam size. The feed array is stationary and the reflector can be mechanically moved over a limited distance along the feed axial direction using articulated mechanisms. The feed array can be located in the focal plane of the reflector or can be defocused. The reflector can be gimbaled along the east-west and north-south directions by using azimuth and elevation gimbal mechanisms. The feed array uses high power switches and beamforming networks (BFN) in order to vary the number of feed elements. The antenna system also consists of a reflector support structure, including a boom for deploying the reflector on-orbit.

By proper combination of the number of elements in the feed array, excitation coefficients of the BFN and the reflector movement, the beam size on ground can be reconfigured over a 1:5 aspect ratio. The antenna system also improves the beam efficiency for larger beams by eliminating the flower-shaped beams associated with conventional designs. This is done by reducing the size of outer elements and adding an additional element, to form an eight element array instead of the conventional seven element array.

DETAILED DESCRIPTION

Figure 1B:
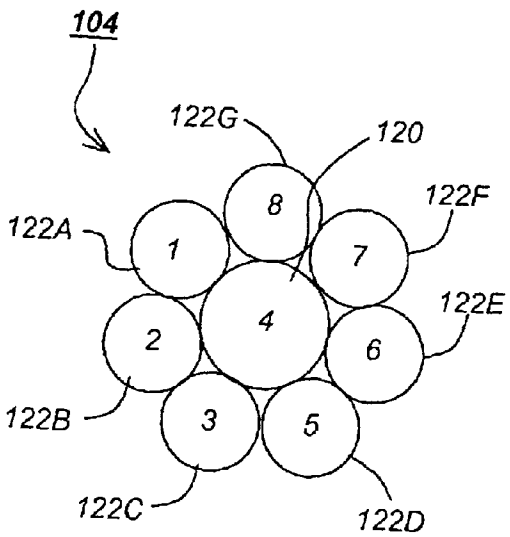
FIG. 1B is a diagram depicting one embodiment of the feed array.
Figure 1A:
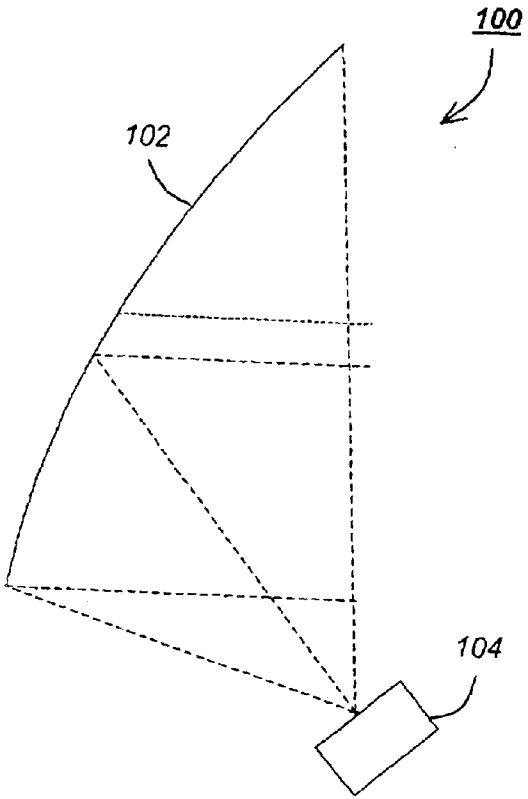
FIG. 1A is a diagram of one embodiment of the reconfigurable antenna system.

FIG. 1A is a diagram of one embodiment of the reconfigurable antenna system 100. It uses a large deployable offset reflector 102 being fed with an 8 element feed array 104. The reflector has a 252 inch diameter projected aperture, a focal length of 160 inches, and an offset clearance of 50 inches in order to avoid the feed array 104 blockage. In the illustrated embodiment, the reflector 102 shape is parabolic but can be other shapes as well, to suit the particular application.

FIG. 1B is a diagram depicting one embodiment of the feed array 104. The feed array 104 includes a primary element 120 and a plurality of secondary elements 122A–122G disposed about the periphery of and surrounding the primary element 120. In one embodiment, the primary element 120 includes a first cup-dipole and the secondary elements include seven or more second cup-dipoles smaller in diameter than the first cup dipole (e.g. 13.0 and 10.0 inches in diameter, respectively.

Figure 2:
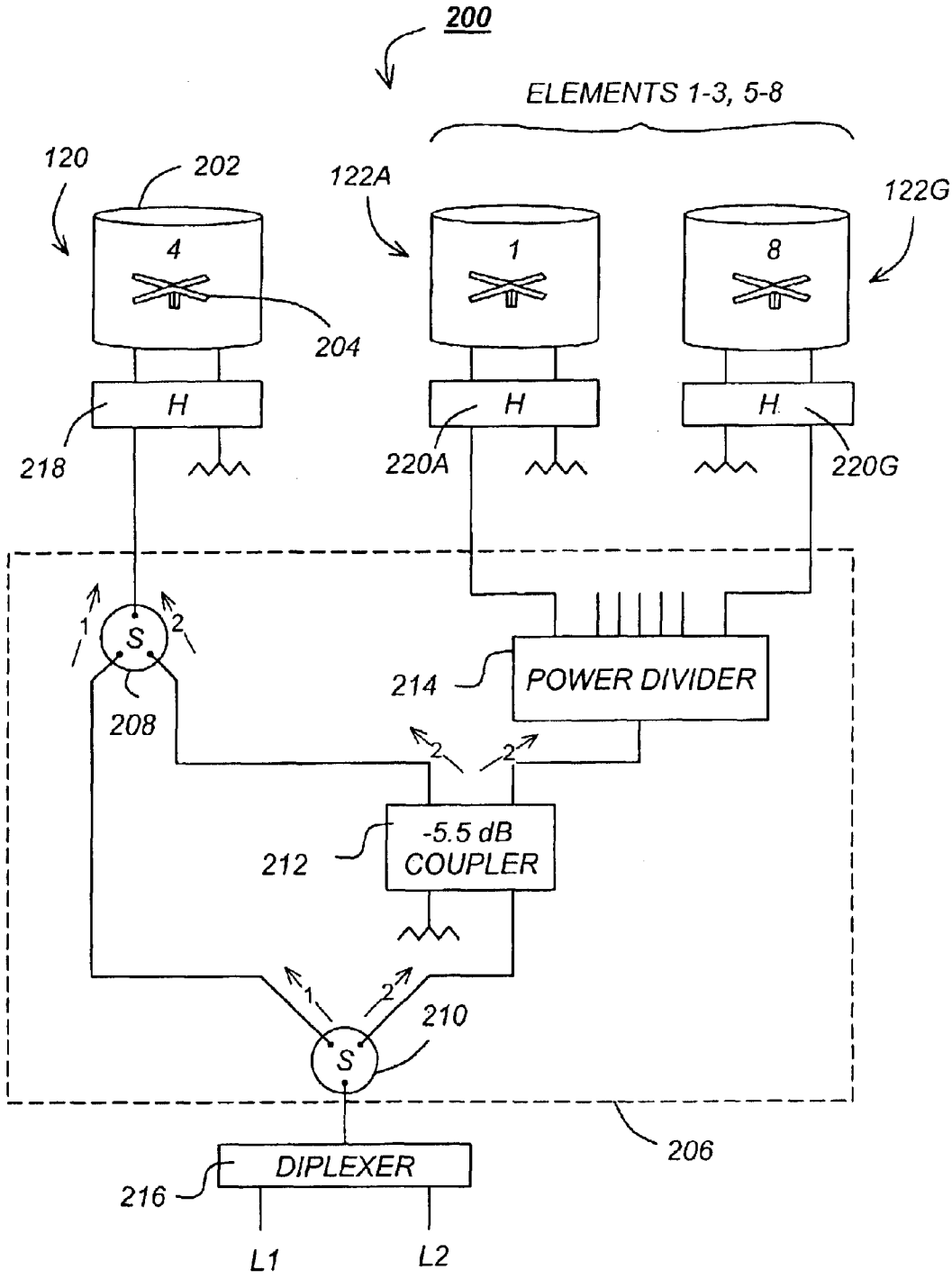
FIG. 2 is a schematic diagram of a driver network that drives the feed array.

FIG. 2 is a schematic diagram of a driver network 200 that drives the feed array 104. The feed array 104 employs an 8-element cup 202 and crossed dipole 204 array fed by a switching network 206 comprising a first high power switch 208 and a second high power switch 210, and a coupler 212. The feed array also employs a 1:7 power dividing network 214, and a diplexer 216 to separate the L1 and L2 frequency bands.

For smaller beam sizes, only the primary element 120 of the feed array 104 is used. This is accomplished by selecting the state of switches 208 and 210 to pass signals as shown in the arrows labeled "1" in FIG. 2. For larger beams, the primary element and one or more of the seven secondary elements are utilized. This is accomplished by selecting the state of switches 208 and 210 to pass signals as shown in the arrows labeled "2" in FIG. 2.

The efficiency and performance of larger beams is significantly improved by using eight elements (102 and 122A–122G). This eliminates the flower-shaped beam contour patterns associated with the conventional 7-element array design. The amplitude and phase excitations of the seven element power divider 214 and the coupling value of the coupler 212 are optimized based on all the beams covering the Earth.

The driver network 200 uses hybrid couplers 218 and 220A–220G behind each cup-dipole element in order to generate circular polarization over wide bandwidth and a high-level BFN (1:7 power divider 214) implemented using a low-loss squarex (TEM-line) medium. Two high power switches 208 and 210 and a coupler 212 allow the flexibility to select either 1 or 8 elements of the feed array 104. The high power diplexer 216 separates the L1 and L2 frequencies with sufficient isolation in order to separate the two frequency bands and minimize their intermodulation products generated by different carrier frequencies.

Figure 3:
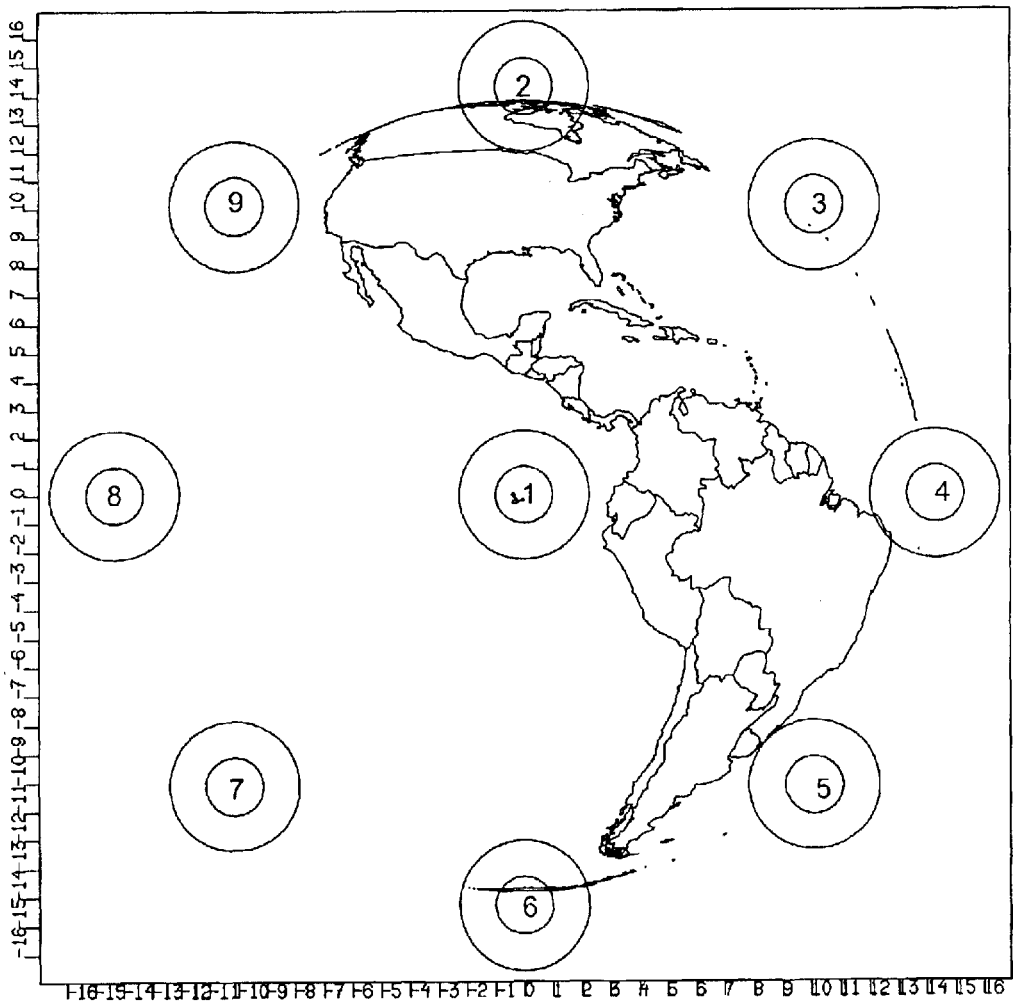
FIG. 3 is a plot of the typical beam coverage from a Medium Earth Orbit (MEO) satellite located at 110 degree west orbital location and typical beamsets covering the Earth.

FIG. 3 is a plot of the typical beam coverage from a MEO satellite located at 110 degrees West orbital location. This plot shows a 600 km (1.7 degree diameter) and a 1500 km (4.23 degree diameter) beam pair over 9 different locations over the Earth (one central beam and 8 peripheral beams located 14.3 degree radially from the central beam). These nine beams are used to optimize the beam performance over the Earth coverage.

Figure 4:
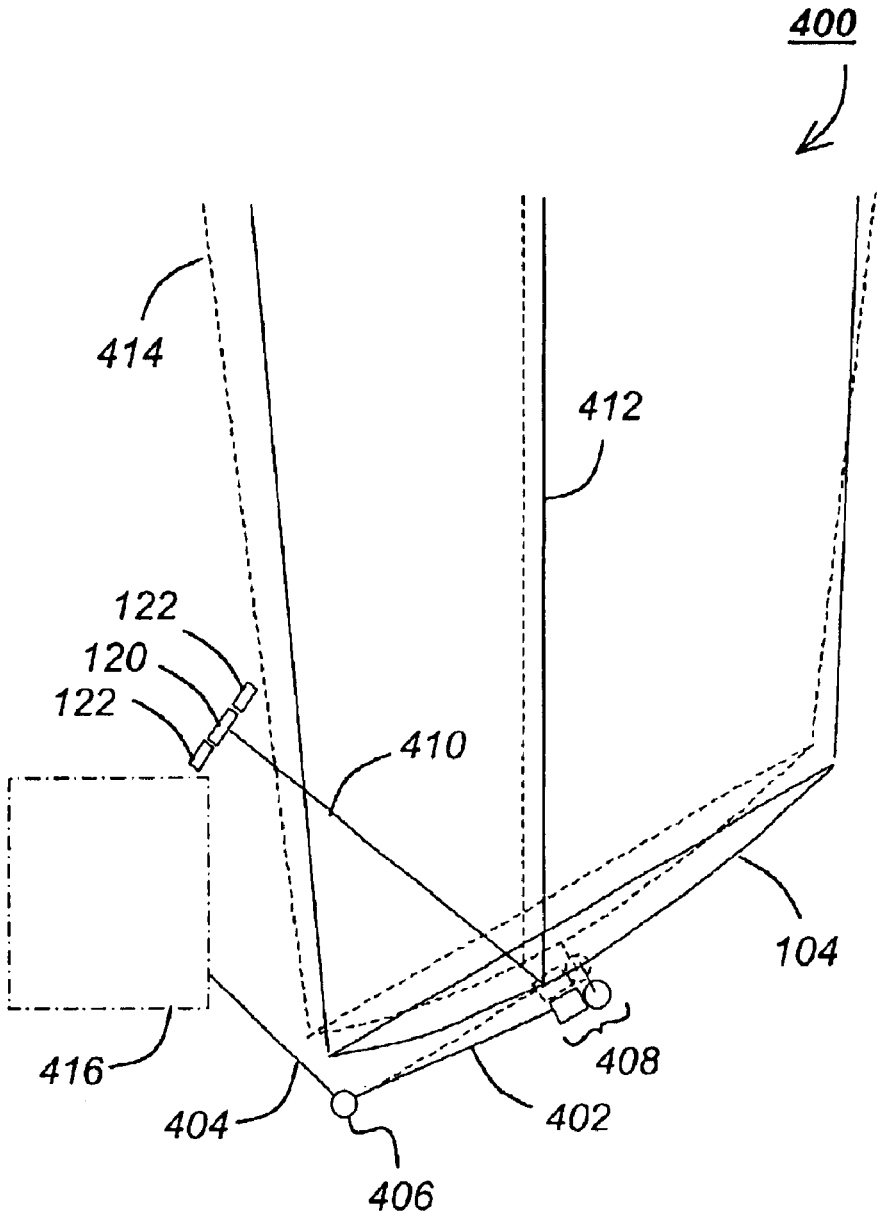
FIGS. 4 and 5 are diagrams showing the operation of the antenna system in the deployed state.
Figure 5:
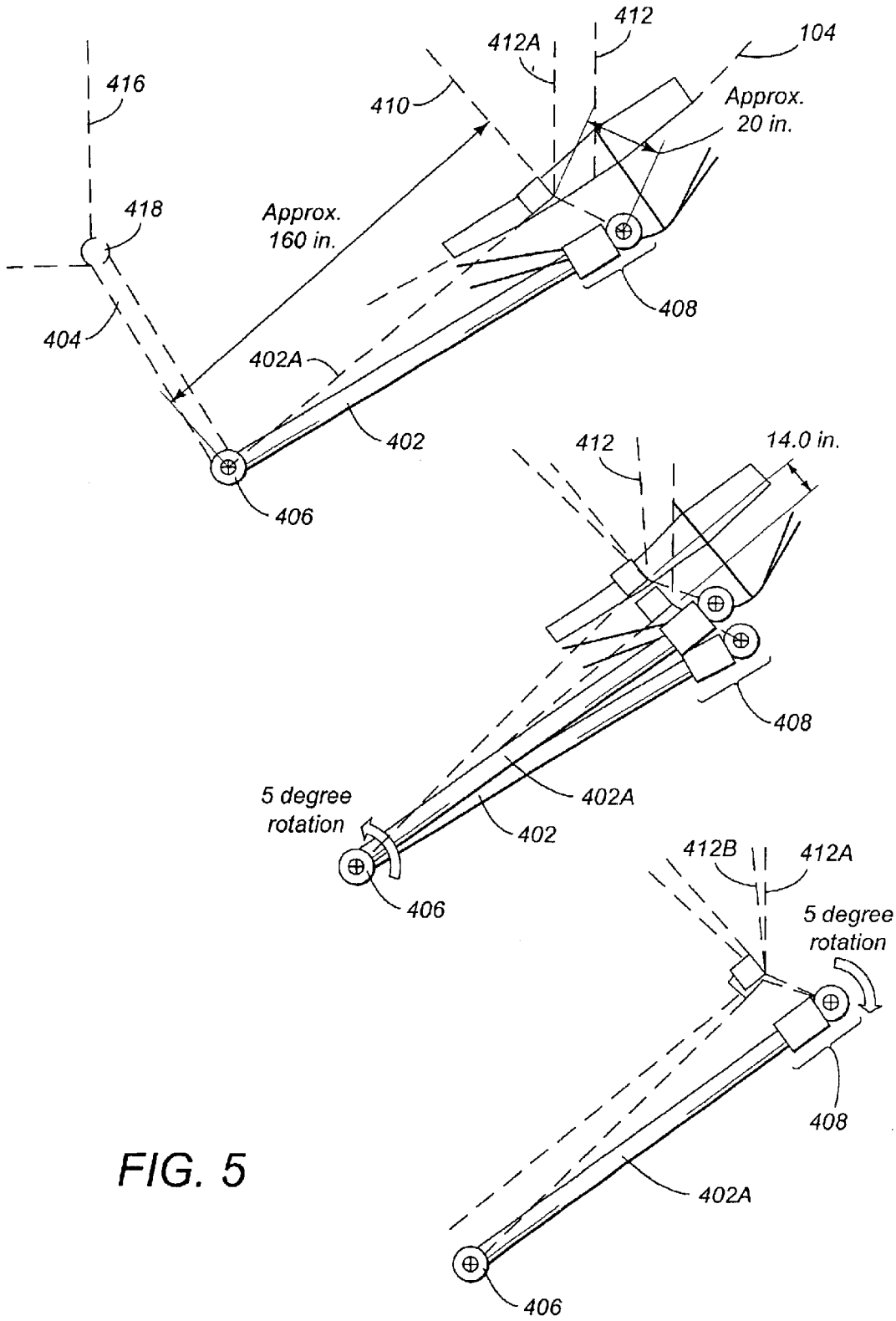

FIGS. 4 and 5 are diagrams showing the operation of the antenna system 400 in the deployed state. The center-mounted reflector 102 is attached to a two-axis gimbal mechanism 408, which provides the capability to steer the spot beams in azimuth and elevation over a 14.3 degree half cone angle of the Earth for a MEO orbit. The reflector assembly 102, 408 is mated to the spacecraft bus structure 416 by a two segment 404, 402 boom structure that uses two deployment actuators (only one is shown 406) to achieve its final on-orbit configuration. The physical movement of the reflector 102, required for larger beams, is achieved through a rotary positioning mechanism (RPM) 406 located between the boom joints 402 and 404 and the gimbal mechanism 408 at the center of the reflector 102. The two-gimbal mechanism 408 allows the beams to steer over the Earth's coverage in both North-South and East-West directions.

Turning to FIG. 5, a 5 degree rotation of the RPM 406 accomplishes a 14 inch reflector 102 movement towards the feed array 104 and along the feed axis 410 (moving boom segment 402 to position 402A). The change in the antenna boresight direction (from 412 to 412B) caused by the RPM 406 rotation is corrected by the gimbal mechanism 408, which rotates the reflector 102 by 5 degrees in the opposite direction of the RPM 406 to position 412A to realign the antenna boresight.

Figure 6A:
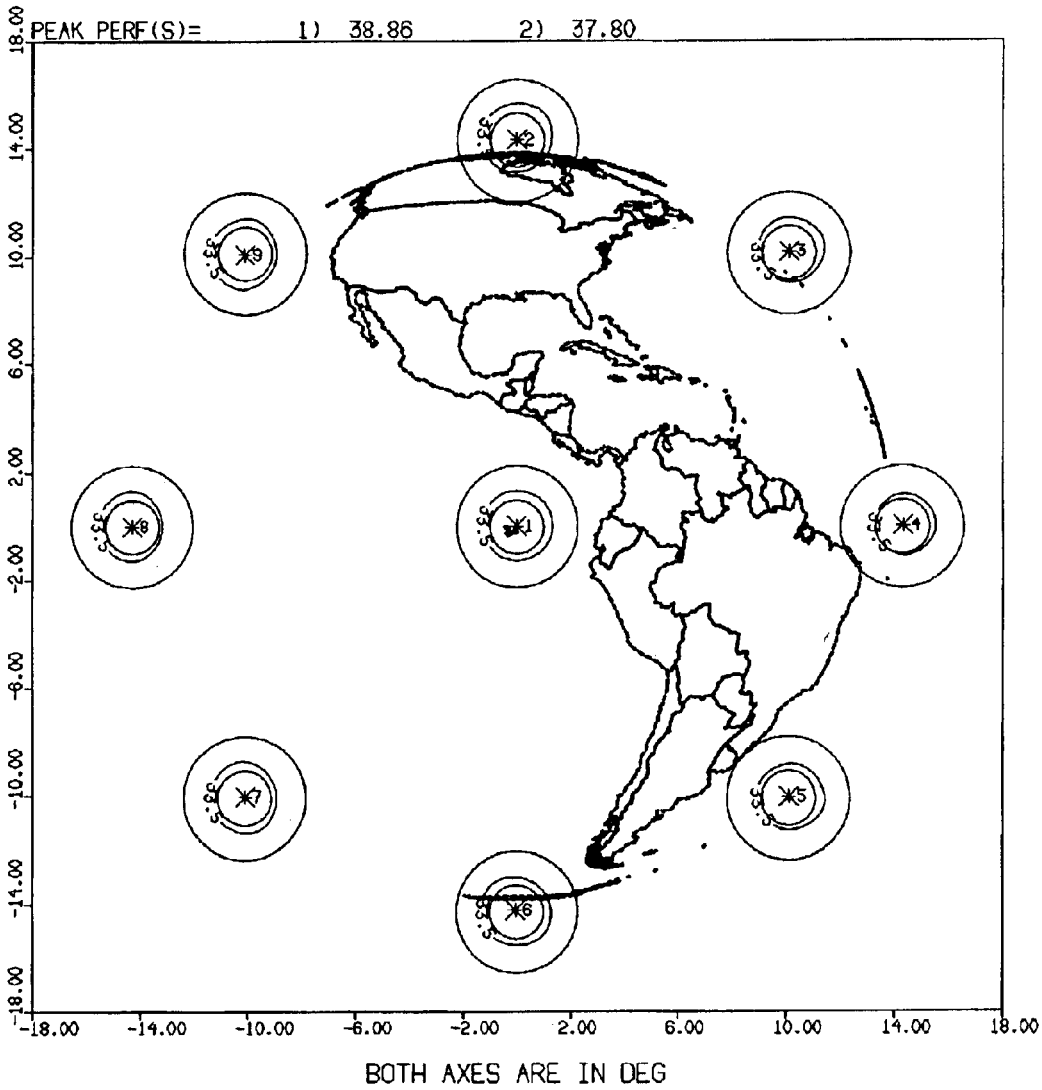
FIG. 6A is a diagram showing the performance of the antenna system for smaller beam foot-print of 600 km wherein only the primary central element of the feed array is used at a first frequency L1=1.585 GHz.
Figure 6B:
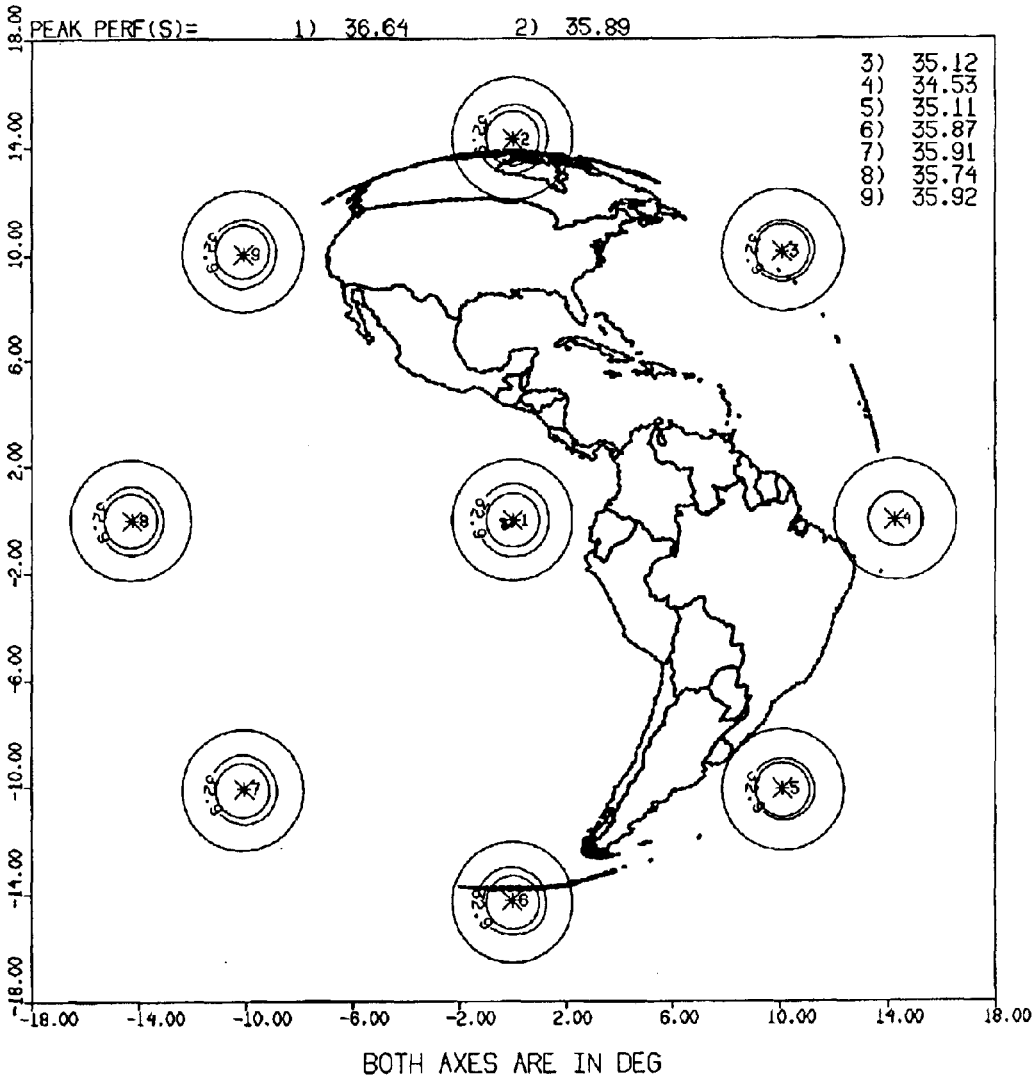
FIG. 6B is a diagram showing the performance of the antenna system for smaller beam foot-print of 600 km wherein only the primary central element of the feed array is used at a second frequency L2=1.226 GHz.

FIGS. 6A and 6B are plots showing the performance of the antenna system 400 for smaller beam foot-print of 600 km (1.7 degrees diameter) wherein only the primary element 120 of the feed array 104 is used. FIG. 6A depicts the performance at L1=1.585 Hz, and FIG. 6B depicts the performance at L2=1.226 GHz. The beam size has been expanded to account for radial pointing error of +/−0.15 degrees, caused by the spacecraft and antenna pointing uncertainties, and the radio frequency (RF) performance has been evaluated over an expanded beam diameter of 2.0 degrees. the reflector remains at its normal position for the smaller beans and does not require physical movement. The reflector is gimbaled to reconfigure its beam location. Worst case directivity values evaluated over the 9 beams (this represents the worst case performance over the earth's field-of-view) are 33.5 dBi and 32.9 dBi at L1 and L2 frequencies.

Figure 7:
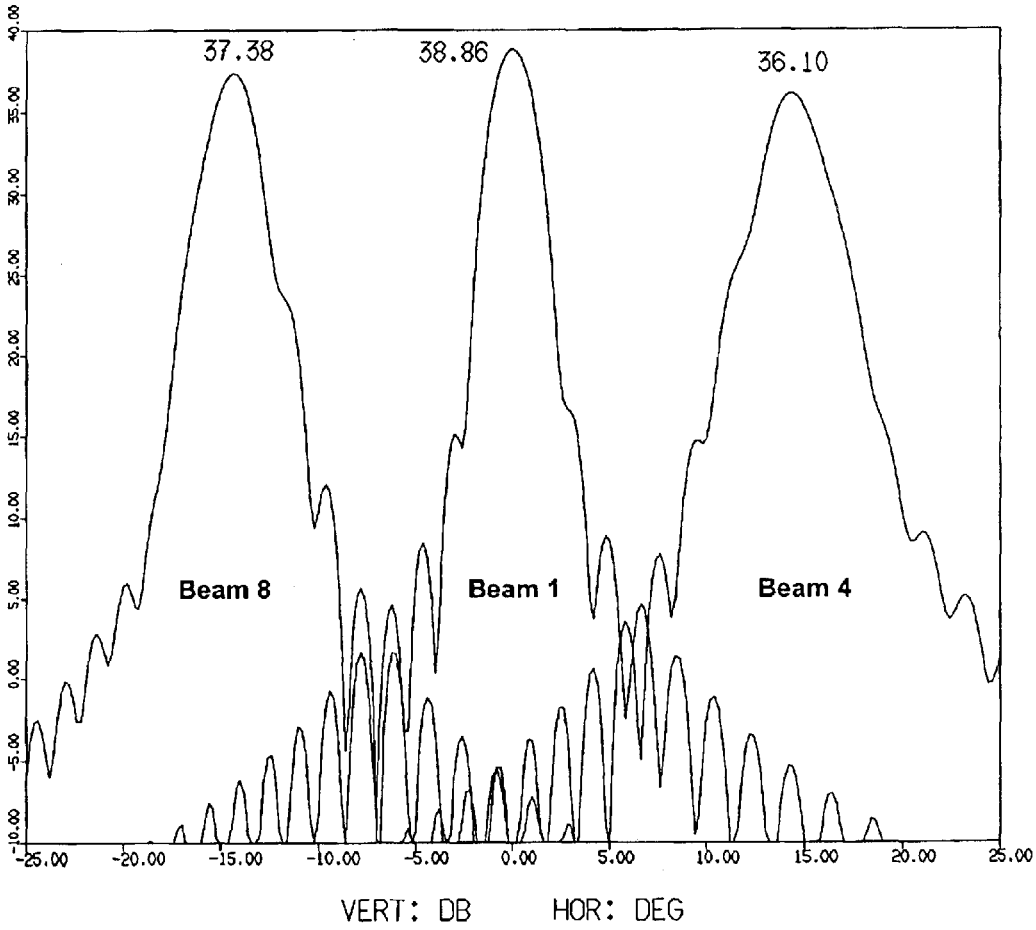
FIG. 7 is a diagram showing a typical beam pattern azimuth cuts for the three east-west beams shown in FIG. 6A.

FIG. 7 is a diagram showing a typical beam pattern azimuth cuts for the three east-west beams shown in FIG. 6. It shows that efficient beams are formed over the global coverage, achieving low side lobe levels.

Larger beam performance has been optimized by using all eight elements of the feed array and by moving the reflector 102 towards the feed array 104 and along the feed axis 410. The extent of the reflector 102 movement depends on the desired beam size (14 in. for 2500 km beam). All of the secondary elements 122 of the feed array 104 are excited with uniform amplitude and phase in order to simplify the BFN 214 and achieve the desired broad bandwidth of 26%. The coupler 212 value is determined based on the optimum excitation value of the outer array (the array of secondary elements 122) relative to the primary element 120. This coupler 222 value is optimized over the desired range of beam foot-prints on ground (1200 km to 2500 km for this example), and for the parameters described above, is about 5.5 dB.

The illustrated beam patterns were computed using these optimized feed array excitations and by moving the reflector 102 towards the feed array 104 (0 to 14 in. physical movement of the reflector 102).

Figure 8A:
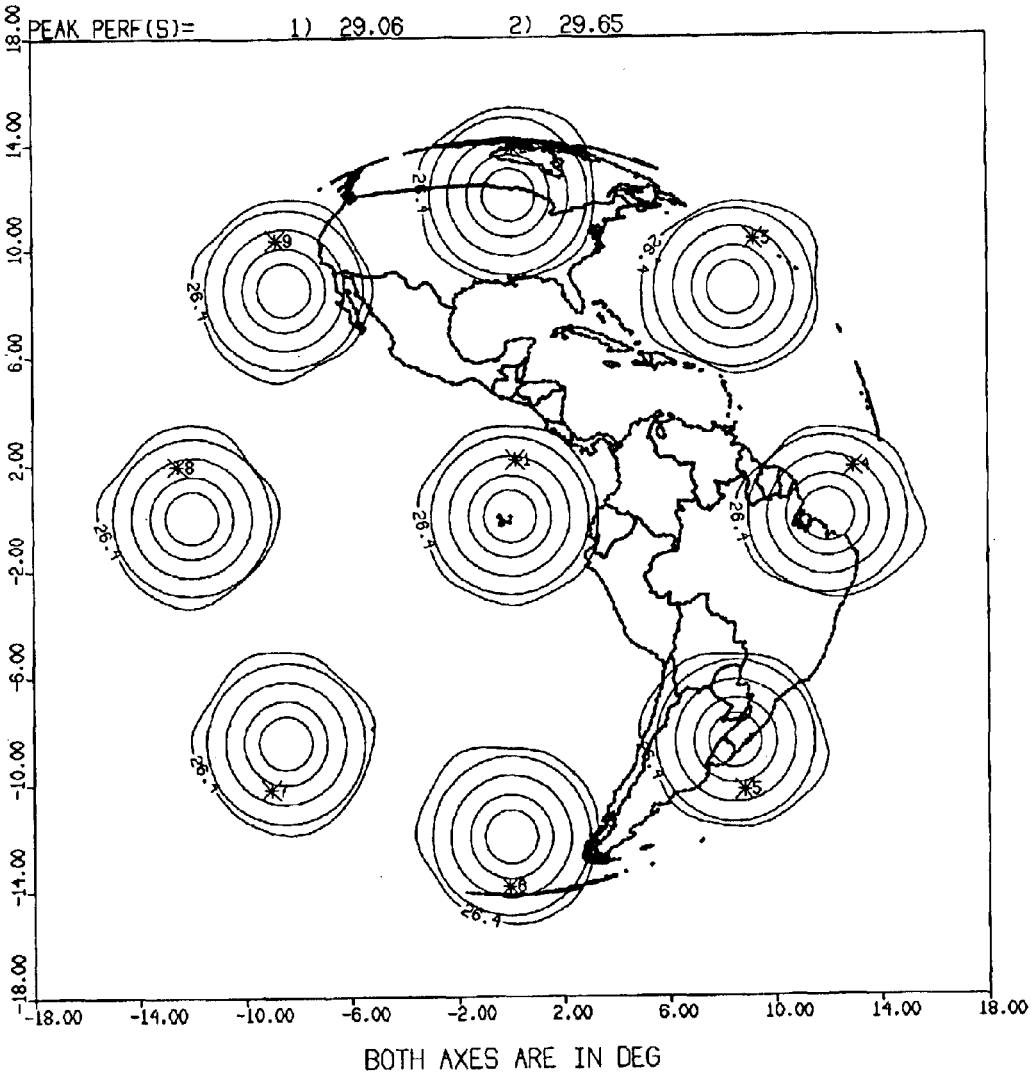
FIGS. 8A and 8B are diagrams illustrating computed beam directivity contours using all the eight feed elements for a 2000 km foot-print for frequencies L1 and L2, respectively.
Figure 8B:
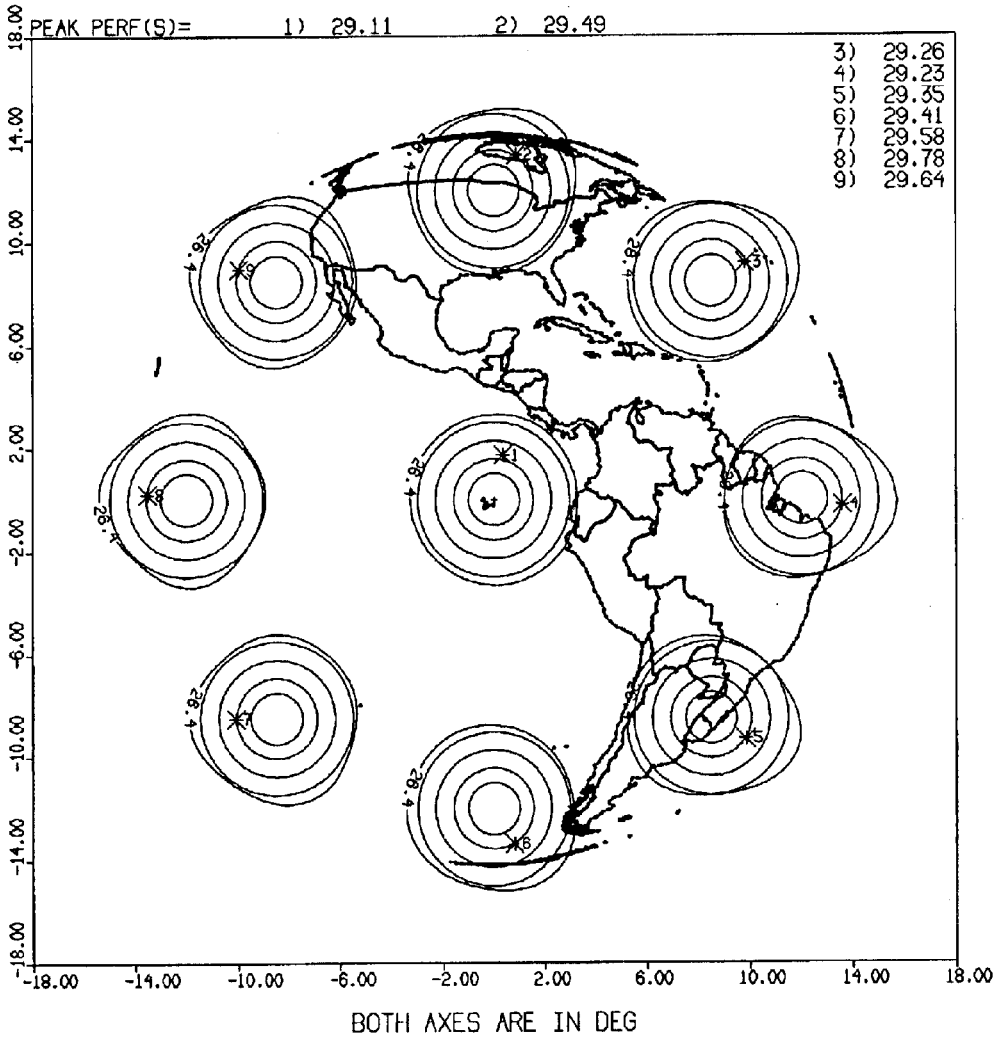

FIG. 8 is a diagram illustrating computed beam directivity contours for a 2000 km foot-print (5.67 deg+2=0.1 5 deg= 5.97 deg)for L1 and L2 frequencies. Minimum directivity value for 5.97 degree beam is 26.41 dBi for both L1 and L2 frequencies over the globe (minimum value based on 9 beams).

Figure 9:
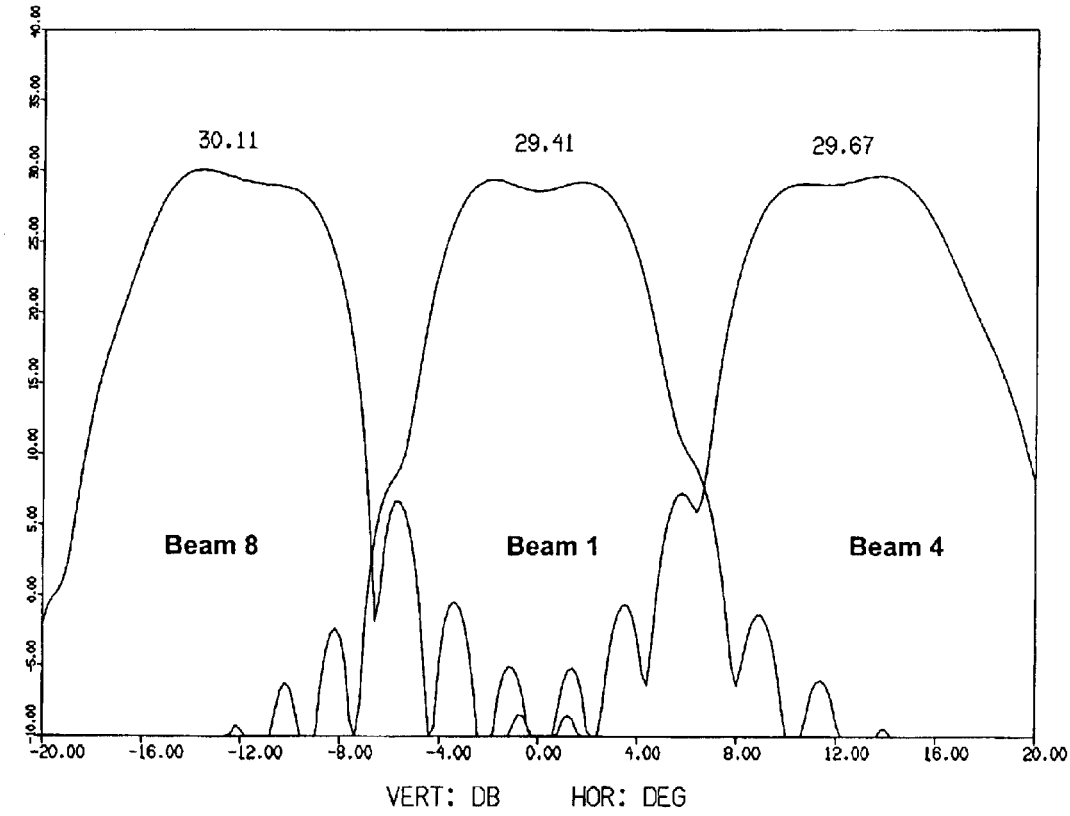
FIG. 9 is a plot showing the azimuth pattern cuts for three beams shown in FIG. 8A.
Figure 10:
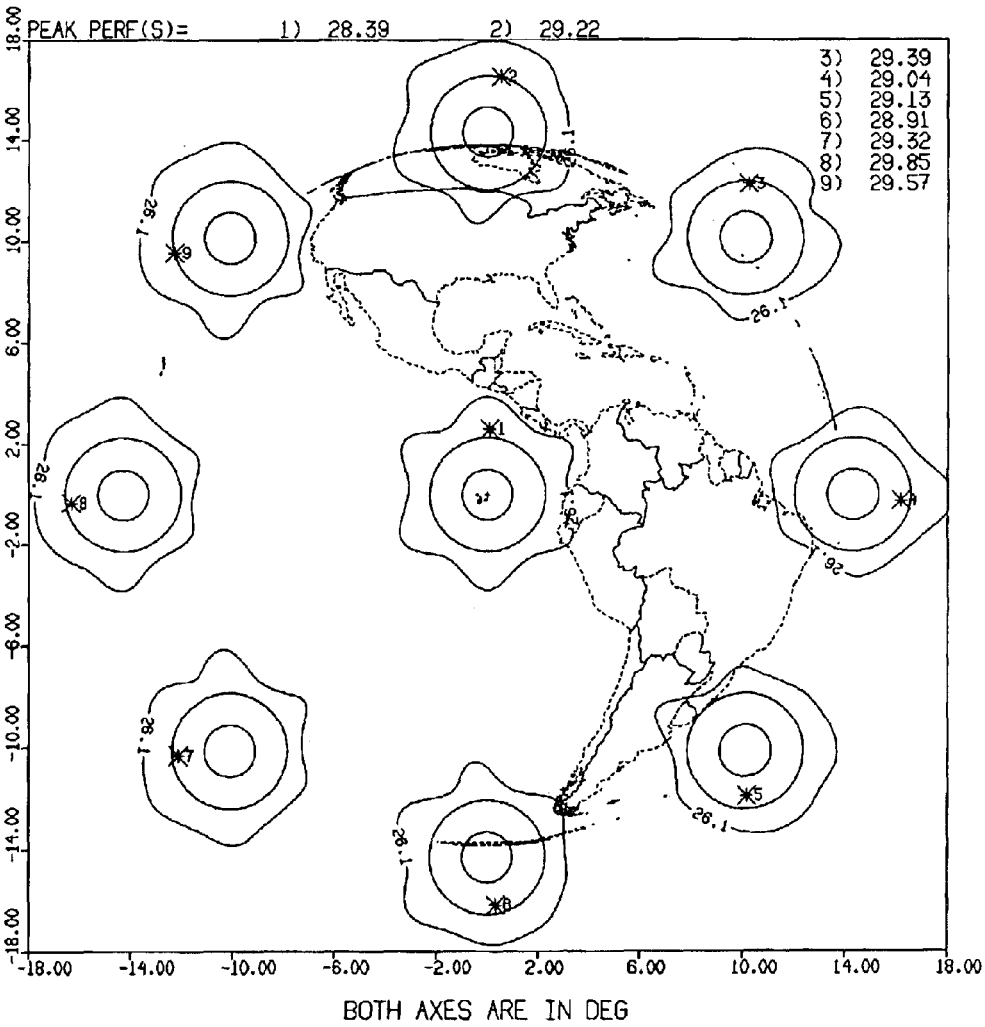
FIG. 10 is a plot of computed directivity contours for 1500 km beam footprints using a conventional seven element feed array.

FIG. 9 is a plot showing the azimuth pattern cuts for three beams (the beam numbers 8, 1 and 4 shown in FIG. 8). The contour plot of FIG. 8 shows that the circularity of the 5.97 degree beam is well maintained with the 8-element antenna system 400, while the conventional design with 7-element array shows flower-shaped contours, as plotted in FIG. 10, even for smaller beam size of 4.53 degrees (1500 km foot-print) diameter.

Figure 11:
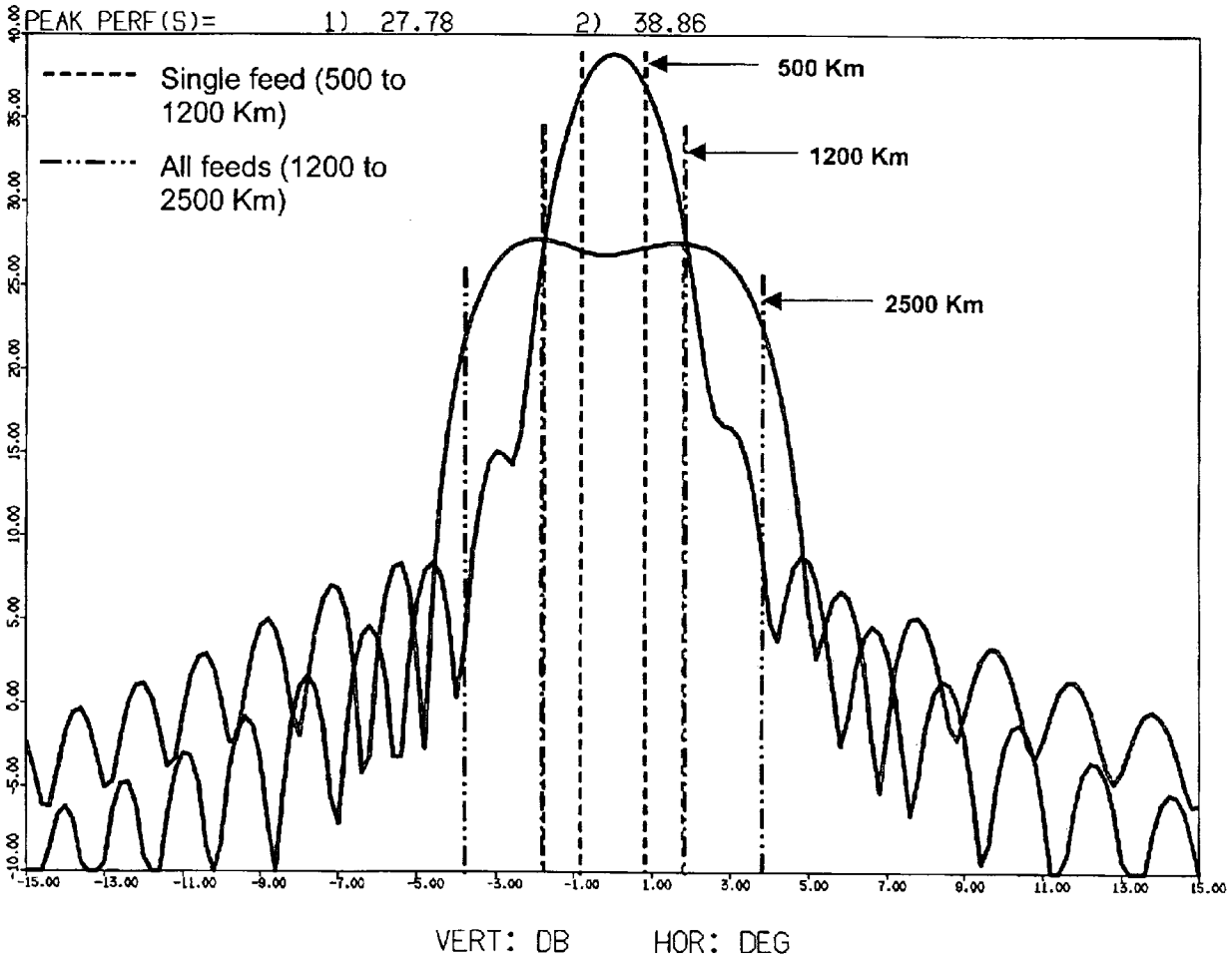
FIG. 11 is a diagram plotting the two variable beam sizes of the antenna system, in which the narrow beams use the primary element to generate beam sizes in the range 500 km to 1200 km and the broader beam using all of the secondary elements to generate beam sizes in the range 1200 km to 2500 k.

FIG. 11 is a diagram plotting the two variable beam sizes of the antenna system 400, in which the narrow beams use the primary element 120 to generate beam sizes in the range 500 km to 1200 km and the broader beam using all the 8 elements 120 and 122A–122G to generate beam sizes in the range 1200 km to 2500 km.

Table I shows a summary of the directivity performance reconfigurable antenna system at the L1 frequency (1.585 GHz). Table II shows a summary of the directivity performance reconfigurable antenna system at the L2 frequency (1.226 GHz). Worst case directivity over the Earth's coverage is shown as the bottom line of each table.

TABLE I

| | 1 Feed | | 8 Feeds | |
|---|---|---|---|---|
| 1.585 GHz | 600Km | 1000Km | 1500Km | 2000Km |
| 1 | 35.51 | 30.27 | 26.41 | 26.41 |
| 2 | 34.64 | 29.59 | 26.5 | 26.5 |
| 3 | 34.01 | 29.58 | 26.59 | 26.57 |
| 4 | 33.52 | 29.56 | 26.62 | 26.51 |
| 5 | 34.13 | 30.11 | 26.48 | 26.48 |
| 6 | 34.85 | 30.95 | 26.62 | 26.62 |
| 7 | 34.82 | 30.22 | 26.93 | 26.85 |
| 8 | 34.26 | 29.36 | 27.04 | 26.5 |
| 9 | 34.66 | 29.91 | 26.76 | 26.74 |
| W.C. | 33.5 | 29.4 | 26.4 | 26.4 |

TABLE II

| | 1 Feed | | 8 Feeds | |
|---|---|---|---|---|
| 1.226 GHz | 600Km | 1000Km | 1500Km | 2000Km |
| 1 | 34.59 | 31.38 | 28.31 | 26.41 |
| 2 | 33.92 | 31.17 | 28.18 | 26.79 |

TABLE II-continued

| | 1 Feed | | 8 Feeds | |
|---|---|---|---|---|
| 1.226 GHz | 600Km | 1000Km | 1500Km | 2000Km |
| 3 | 33.35 | 30.77 | 28.13 | 26.6 |
| 4 | 32.92 | 30.36 | 27.99 | 26.48 |
| 5 | 33.28 | 30.67 | 27.95 | 26.43 |
| 6 | 33.84 | 31.07 | 28.16 | 26.7 |
| 7 | 33.82 | 31.06 | 28.11 | 26.71 |
| 8 | 33.69 | 30.79 | 27.93 | 26.41 |
| 9 | 33.71 | 30.83 | 28.13 | 26.77 |
| W.C. | 32.9 | 30.4 | 27.9 | 26.4 |

The present invention can be extended to larger beam aspect ratios (beam size reconfigurability beyond the 1:5 ratio) by using a larger feed army 104 with increased number of elements 120, 122A–122G, and 120F.

Figure 12A:
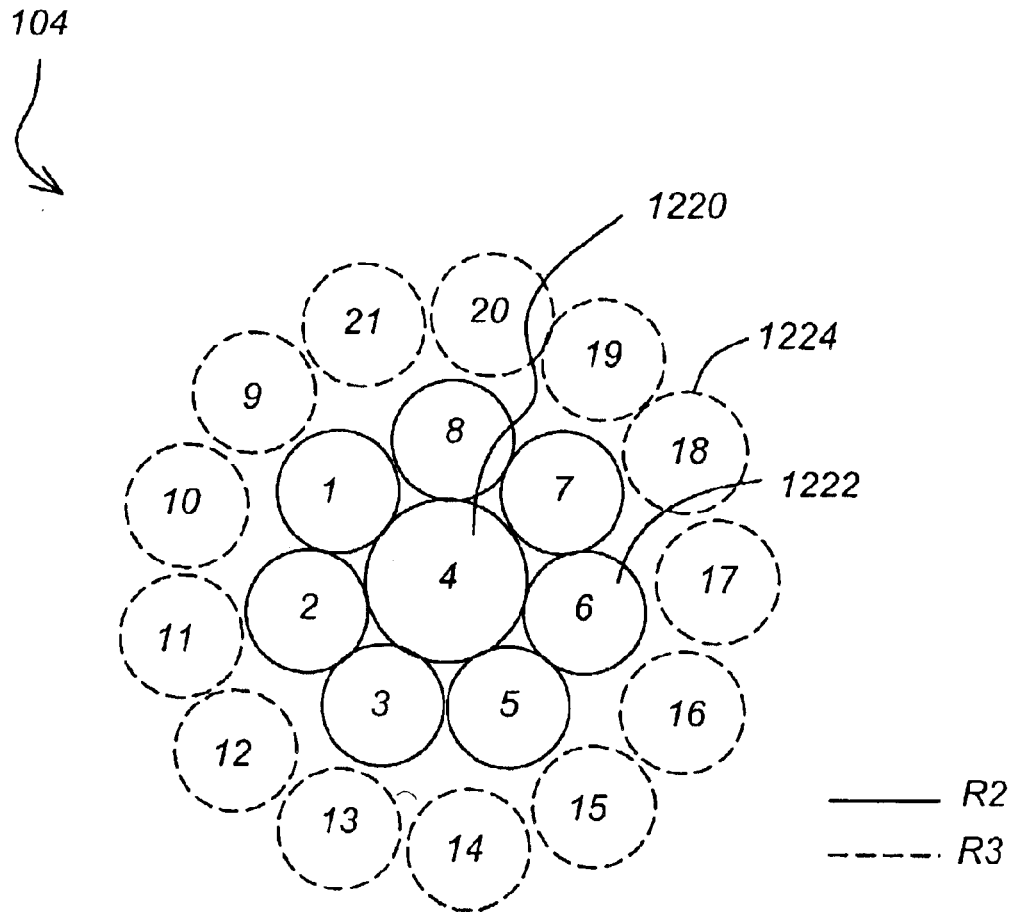
FIGS. 12A and 12B are diagrams depicting another embodiment of the present invention, using a feed array with more elements.
Figure 12B:
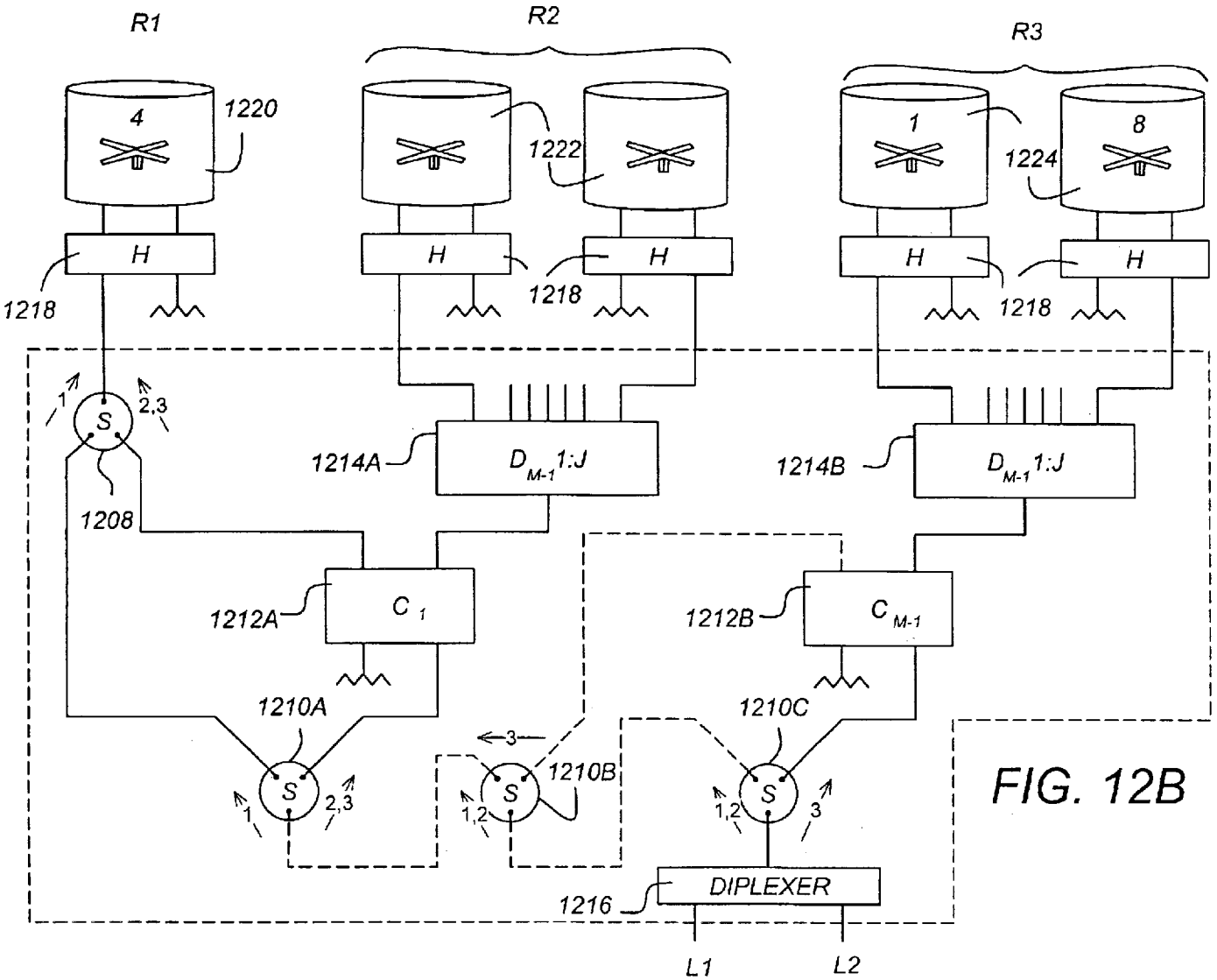

FIGS. 12A and 12B are diagrams depicting another embodiment of the present invention.

FIG. 12A is a diagram depicting another embodiment of the feed array 104. In this embodiment, the secondary elements 1222, 1224 are disposed around the periphery of the primary element 1220 in a plurality of rings including an inner ring R2, indicated it by the solid line in FIG. 12A, and an outer ring R3, indicated by the dashed line in FIG. 12A. Inner ring R2 includes a plurality of secondary elements 1222 disposed about the primary element 1220, and outer ring R3 includes a plurality secondary elements 1224 disposed about the periphery of inner ring R2. In a more general case, the number of rings can be extended beyond three.

FIG. 12B Is a diagram of a driver network 1200 that can be used with the feed array depicted in FIG. 12A Primary element 1220, switches 1208 and 1210A, coupler 1212A, BFN 1214A, and secondary elements 1222 are coupled and operate analogously to the corresponding features depicted in FIG. 2. In this embodiment, however, these elements a operate with a secondary network 1230.

Secondary network 1230 includes a first switch 1210C coupled to high-power diplexer 1216. The first switch 1210C directs energy to the secondary elements in ring R3, or to switch 1210B (and thereby to switch 1210A) and the elements 1222 in ring R2, thus providing for the selective activation of secondary elements 1222 in ring R2. Elements 1224, BFN 1214B, and coupler 1212B operate analogously to the elements 1222 of ring (2, BFN 1214A, and coupler 1212A.

Hence, the primary element 1220 alone can be activated (by selection of switches 1208, 1210A, 1210B, and 1210C to route signals as shown in the arrows labeled "1" in FIG. 12B), the primary element 1220 and secondary elements 1222 in the second ring (by selection of switches 1208, 1210A, 1210B, and 1210C to route signals as shown in the arrows labeled "2" in FIG. 12B), or the primary element 1220, and the secondary elements 1222, 1224 in both rings R2 and R3 (by selection of switches 1208, 1210A, 1210B, and 1210C to route signals as shown in the arrows labeled "3" in FIG. 12B).

When compared to the embodiment shown in FIG. 2, this feed array network can achieve more flexibility in terms of beam size reconfiguration, but this improvement comes at the expense of increased complexity and cost.

The embodiment shown in FIGS. 12A and 12B can be expanded to accommodate further rings RN of feed elements. It is also noted that the elements disposed in ring R3 can differ in design from those of ring R2. For example, feed elements 1224 can be lower power elements than feed elements 1222, if desired. Also, each of the elements in rings R2 or R3 need not be identical in design. For example, elements 1222 of ring R2 may each be designed to output different power levels, or to be controllable in different ways, as required to achieve beam control and reconfiguration requirements. The Applicants' invention is also applicable to other frequency bands such as C, Ku & Ka used for communication satellites to provide fixed-satellite (FSS) and broadcast-satellite (BSS) services.

CONCLUSION

This concludes the description of the preferred embodiments of the present invention. The reconfigurable beam antenna system described above provides a simple and an efficient way to reconfigure the beams of communications satellites on orbit without the need for active components such as variable phase shifters and variable attenuators. It is also inexpensive, yet provides high degree of beam reconfiguration.

The antenna system employs an offset single reflector illuminated with a feed array. The beam size is controlled by keeping the feed array stationary while varying in the number of elements in feed array according to the desired beam size. This is accomplished through the use of high power switch(es) and passive beam-forming network(s) realized at high-level by using low-loss transmission media. Additional control over the beam size is achieved by moving the reflector along the axial direction towards the feed array by one or more articulating mechanisms behind the reflector. This defocusing technique extends the range of beam size reconfiguration beyond that which is achievable by other techniques. The beam can also be relocated in direction as well as size, by use of a gimbal mechanism behind the center of the reflector. The gimbal mechanism steers the reflector and hence the beams along the east-west and north-south directions over the earth's field-of-view.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An antenna system, comprising:

a stationary feed array having a plurality of selectably activatable feed array elements, the feed array having a feed array sensitive axis;

a reflector illuminated by the selectably activatable feed array elements;

a first mechanism, coupled to the reflector, for varying a position of the reflector along the feed array sensitive axis;

wherein a desired beam size of the antenna system is selected by varying the reflector position along the feed array sensitive axis and by selectably activating the feed array elements.

2. The antenna system of claim 1, further comprising:

a second mechanism for rotating the reflector to select a desired beam direction.

3. The apparatus of claim 2, wherein the second mechanism comprises a gimbal mechanism.

4. The apparatus of claim 3, wherein the gimbal mechanism is rotatable in an elevation and an azimuth axis.

5. The apparatus of claim 2, wherein the first mechanism varies the position of the reflector along the feed axis and rotates the reflector in a first direction, and wherein the second mechanism rotates the reflector in a second direction opposite the first direction.

6. The apparatus of claim 1, wherein the first mechanism is a articulated rotary positioning mechanism.

7. The antenna system of claim 1, wherein:

the plurality of selectively activatable feed array elements comprising a primary feed array element, and a plurality of secondary feed elements smaller than the primary feed element, and wherein the secondary feed elements are disposed peripherally around the primary feed element.

8. The apparatus of claim 7, wherein the plurality of secondary feed elements comprise at least se secondary feed elements.

9. The apparatus of claim 7, wherein the primary feed element emits a greater power illumination than the secondary feed elements.

10. The antenna system of claim 7, further comprising:

a switch network, for selecting between the primary feed element and the secondary feed elements; and a power dividing network coupled to the switch network, for selectably activating the secondary feed elements.

11. The apparatus of claim 10, wherein the switch network comprises a plurality of high power switches.

12. The apparatus of claim 1, wherein the reflector has a parabolic shape.

13. An antenna system, comprising:

a stationary feed array means having a plurality of selectably activatable feed array element means, the feed array having a feed array sensitive axis;

a reflector means, illuminated by the selectably activatable feed array elements means;

a first mechanism, coupled to the reflector, for varying a position of the reflector means along the feed array sensitive axis; and wherein a desired beam size of the antenna system is selected by varying the position of the reflector means along the feed array sensitive axis and by selectably activating the feed array element means.

14. The antenna system of claim 13, further comprising a second mechanism for rotating the reflector to select a desired beam direction.

15. The apparatus of claim 14, wherein the second mechanism comprises a gimbal mechanism.

16. The apparatus of claim 15, wherein the gimbal mechanism is rotatable in an elevation and an azimuth axis.

17. The apparatus of claim 14, wherein the first mechanism varies the position of the reflector means along the feed axis and rotates the reflector means in a first direction, and wherein the second mechanism rotates the reflector means in a second direction opposite the first direction.

18. The apparatus of claim 13, wherein the first mechanism is an articulated rotary positioning mechanism.

19. The antenna system of claim 13, wherein:

the plurality of selectively activatable feed array element means comprises a primary feed array element means, and a plurality of secondary feed element means smaller than the primary feed element, and wherein the secondary feed element means are disposed peripherally around the primary feed element means.

20. The apparatus of claim 19, wherein the plurality of secondary feed element means comprises at least seven secondary feed elements.

21. The apparatus of claim 19, wherein the primary feed element means emits a greater power illumination than the secondary feed element means.

22. The antenna system of claim 19, further comprising:

a switch means, for selecting between the primary feed element means and the secondary feed element means; and a power divider means, coupled to the switch means, for selectably activating the secondary feed element means.

23. The apparatus of claim 22, wherein the switch means comprises a plurality of high power switches.

24. The apparatus of claim 13, wherein the reflector means has a parabolic shape.

25. A method of communicating a beam with an antenna system, comprising the steps of:

illustrating a reflector from a stationary feed array having plurality of feed array elements; and changing a width of the beam by varying a distance of the reflector from the feed array along a feed array sensitive axis and selectably activating the feed array elements.

26. The method of claim 25, further comprising the step of rotating the reflector to change the direction of the beam.

27. The method of claim 25, wherein:

the plurality of selectably activatable feed array elements comprises a primary feed array element, and a plurality of secondary feed elements smaller than the primary feed element, and wherein the secondary feed elements are disposed periphery around the primary feed element.

28. The method of claim 25, wherein the feed array comprises at least two rings of secondary elements.

29. The method of claim 28, wherein the reflector comprises a non-parabolic shape.

* * * * *